United States Patent [19]

Cox, Jr.

[11] 4,294,586

[45] Oct. 13, 1981

[54] GASOLINE AND DIESEL FUEL ADDITIVE

[76] Inventor: Charles P. Cox, Jr., 208 S. Sunnyside Rd., Decatur, Ill. 62522

[21] Appl. No.: 156,843

[22] Filed: Jun. 5, 1980

[51] Int. Cl.[3] ..... C10L 1/18

[52] U.S. Cl. ..... 44/56; 44/53; 44/77

[58] Field of Search ..... 44/53, 56, 77

[56] References Cited

U.S. PATENT DOCUMENTS

| | | | |
|---|---|---|---|
| 1,419,910 | 6/1922 | Backhaus | 44/56 |
| 1,684,685 | 9/1928 | Records | 44/53 |
| 1,766,501 | 6/1930 | Buerk | 44/53 |
| 3,902,868 | 9/1975 | Zoch, Jr. | 44/52 |

*Primary Examiner*—Jacqueline V. Howard
*Attorney, Agent, or Firm*—John W. Huckert

[57] ABSTRACT

A gasoline and diesel fuel additive comprising a mixture of alcohol, toluene, and hydrogen peroxide. The preferred ratio is 16/8/1 of these substances. Also for the purpose of quality control when the additive is to be used with diesel fuel, a few drops of diesel fuel and several drops of glycerin are added to the additive mixture to determine if the proper mixture and blending has been achieved. The process of making this additive includes vigorous agitation of the substances as they are blended together in the order of a predetermined amount of toluene being added to a predetermined quantity of alcohol, and then a chosen amount of hydrogen peroxide being added thereafter. Followed by the vigorous blending of these substances, and then immediate putting of the mixture into suitable containers, and tightly sealing the containers to prevent deterioration of the additive mixture.

18 Claims, 4 Drawing Figures

| | | | | | | | | |
|---|---|---|---|---|---|---|---|---|
| (BMR) TOLUENE / ALCOHOL | 4/1 | 3/1 | 2/1 | 1/1 | 1/2 | 1/3 | 1/4 | 1/5 |
| (FMR) $H_2O_2$/TOLUENE/ ALCOHOL | 1/32/8 | 1/24/8 | 1/16/8 | 1/8/8 | 1/8/16 | 1/8/24 | 1/8/32 | 1/8/40 |

GASOLINE AND DIESEL FUEL ADDITIVE

BACKGROUND OF THE INVENTION

1. Field of the Invention

This invention relates to fuel additives for use with gasoline and diesel fuels for the purpose of increasing the octane or cetane rating respectively thereof.

2. Description of the Prior Art

A common problem with known type additives for use with fuels as used with various types of engines is that they either are extremely expensive, they have a very undesirable odor thereto, and/or they fail to actually increase the octane or cetane rating of the fuel for which they are used, or if they do increase these ratings, such as tetraethyl lead, they are very undesirable for use in certain types of engines having pollutant control attachments such as catalytic converters. It is well known that any lead in fuel used with an engine system having a catalytic converter, very quickly renders inoperable the proper operation of the catalytic converter.

SUMMARY OF THE INVENTION

An object of the present invention is to provide a fuel additive for use with both gasoline and diesel fuels which will increase the respective octane and cetane rating thereof without adding any undesirable materials to the fuel which can be harmful to attachments used with the engine, such as catalytic converters in the exhaust system.

Another object of this invention is to provide a fuel additive which will increase the overall effectiveness of said fuel by effecting more complete combustion thereof, provide more power in the engine during utilization of the fuel, and assure a cleaner exhaust emission.

Another further object of this invention is to provide an additive which will when mixed with the proper quantity of fuel absorb and render harmless any moisture or water present in the fuel which otherwise could be detrimental to engine operation.

A still further object of this invention is to provide an additive quite mixable with the fuel for which it is to be used, and which will stay in proper mixture suspension when bottled, and until put to use with a fuel.

A still further object of this invention is to provide a method of preparing a fuel additive which will effect the aforestated objects in the best manner possible.

The fuel additive of subject invention is basically a combination of three substances properly blended together. The substances are toluene, alcohol, and hydrogen peroxide.

By properly mixing these substances together in the manner set forth, an additive is achieved which will substantially increase performance and fuel economy of the average internal combustion engine as presently used on automotive-type vehicles. Also, this additive will substantially increase performance of any type of engine using either #2 diesel fuel or regular or straight-run gasoline.

It is also believed that this additive may be useful with any type device using fuels for heating and combustion such as space heaters, oil burner type furnaces.

Test results have indicated increased highway mileage when the additive of the present invention is used with vehicular engines in normal everyday usage. Tests have indicated an increase in highway mileage of from 10 to 35% when the additive is properly used.

The process disclosed for making the additive is an important part of the invention. It is necessary for producing an additive which will retain the desired properties, and will achieve the desired performance improvement when added to the proper quantity of gasoline or diesel fuel.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
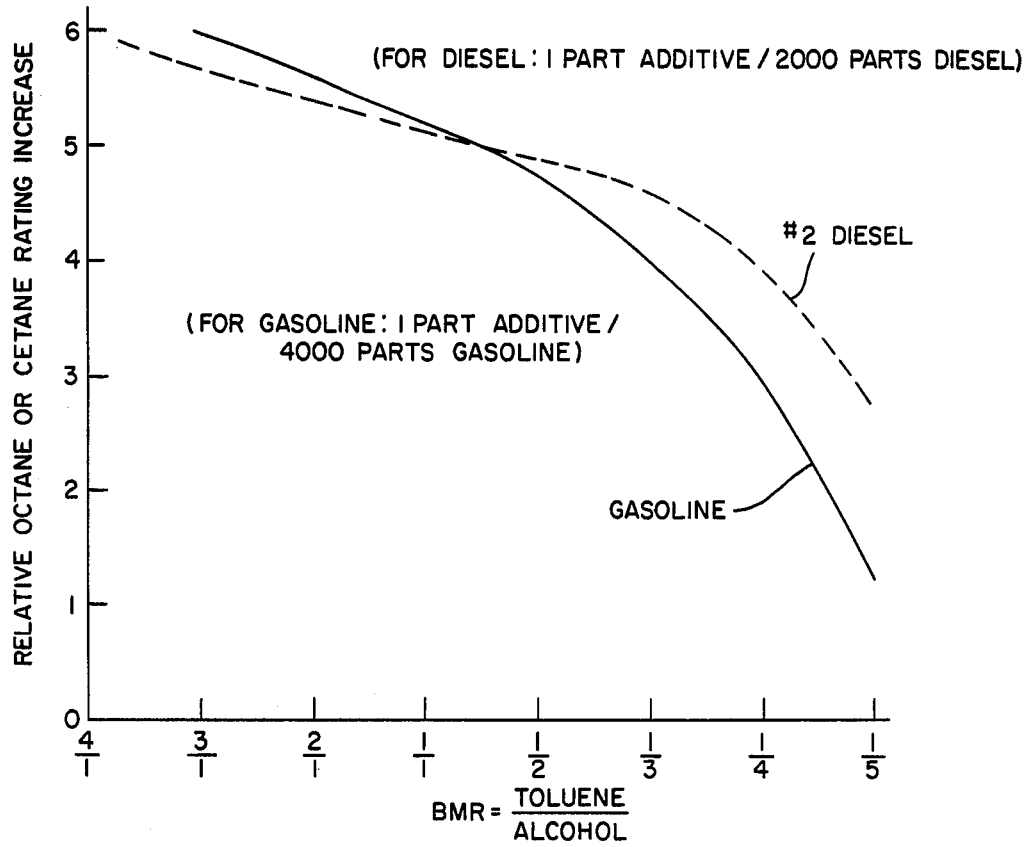
FIG. 1 is a graph showing the effectivity of the additive when used with either gasoline or #2 diesel fuel.

Referring to FIG. 1 of the drawing, the basic effectiveness of the various additive mixtures which are workable with either gasoline or 190 2 diesel fuel are indicated. The preferred embodiment envisions a mixture of one part by volume of $H_2O_2$, eight parts by volume of toluene, and sixteen parts by volume of alcohol. This preferred mixture would correspond with the center portion of the x ordinate of the graph of FIG. 1. That is the position indicated by P. This is the preferred mixture of the additive, which together with the recommended amount of either gasoline or diesel, which in this case would be 1 ounce of additive to 4,000 ounces (approximately 30 gallons) of gasoline, or 1 ounce of additive to 2,000 ounces (approximately 15 gallons) of #2 diesel oil produces good results. By looking at the chart, it can be readily seen that for either gasoline or 190 2 diesel the approximate increase in the respective octane or cetane rating is 5.

This chart also indicates that as the amount of toluene to alcohol is increased, i.e. movement towards the left from the center position along the x ordinate, the octane or cetane rating of both the gasoline and diesel fuels increases slightly toward the value of 6. And likewise as the amount of toluene in proportion to alcohol is decreased, i.e. movement towards the right along the x coordinate, there is a falloff in rating for both the gasoline and #2 diesel. It being quite apparent that the gasoline falloff is a little quicker and more pronounced than that for the diesel fuel.

The basic ingredients as used in the additive of subject invention will now be described in greater detail. Toluene because of its ring-type molecular structure when mixed with gasoline can provide a convenient and effective means of increasing the octane rating. It is believed that this is effected through the separation of the chain-type molecules of straight-run gasoline components by the use of toluene. However, while the beneficial results set forth herein are supported by tests, it is not really certain as to how these desired benefits are effected by the additive of subject invention. Similarly, the cetane rating of diesel fuels are likewise increased by a proper mixing of the additive of subject invention with diesel fuel, but the actual reason therefore it not completely understood.

It has been discovered that toluene will reduce or eliminate predetonation and after-burning of the gasoline and air mixture in the combustion chamber of an internal combustion engine. However, if mixed with alcohols first, and then mixed with gasoline, the effectiveness of toluene as an octane-booster is considerably enhanced. Likewise the toluene when combined with alcohol and used as a diesel fuel additive increases the cetane rating thereof. The various basic mixtures of toluene and alcohol are referred to on the graph of FIG. 1 as BMR for Basic Mixture ratio. This ratio is valid quatity-wise based on volume regardless of the type of alcohol used with the toluene.

There are many types of alcoholic substances which are usable, but for the purpose of the additive of subject invention the following four types have been discovered to be most suitable. They are as follows:

| | |
|---|---|
| Methyl Alcohol (Methanol) | $CH_3OH$ |
| Ethyl Alcohol (Ethanol) | $CH_3CH_2OH$ |
| n-Propyl Alcohol | $CH_3CH_2CH_2OH$ |
| Isopropyl Alcohol | $CH_3CHOH\ CH_3$ |

These four alcohols are believed to be most suitable because of their solubility in both water and fuels, and their overall effectiveness in boosting the performance and fuel economy of engines. Also it has been discovered that the use of these alcohols in the additive of the present invention enhances the effectiveness of the toluene and therefore the overall effectiveness of the additive. However, the major purpose of the use of alcohol in the additive is because of its solubility with both water and oil-based alkanes such as toluene and fuel. Thus, the alcohol serves as an emulscent to permit ease of combination or blending of a strong hydrogen peroxide (a water-based compound) with toluene and fuel.

Hydrogen peroxide ($H_2O_2$) is available in many strengths from a few percent to perhaps 80% or more. The extra atom of oxygen of hydrogen peroxide is in suspension in water and in an unstable condition wherein the oxygen is eager to escape unless held under slight pressure in the container in which it is stored.

In making the additive of subject invention it is preferred to use hydrogen peroxide in concentrations of from 35% to 50%, although higher concentrations could actually be used. Because the oxygen atoms in excess in the water-base of hydrogen peroxide constantly are trying to escape, it is useful as an oxidizer for the fuel vapor when it enters the engine combustion chamber. As such, the hydrogen peroxide effects a desirable benefit of more complete burning of the products of fuel which in turn reduces contamination and provides increased power. Even crankcase oil which in some slight degree always bypasses the piston rings of an internal combustion engine, is burned in the combustion process because of the hydrogen peroxide, thus providing more power to the engine and assuring a cleaner exhaust emission.

As already indicated the preferred ratio of these substances as blended together, i.e. toluene, alcohol, and hydrogen peroxide is in the ratio of 16 parts alcohol, 8 parts toluene, and 1 part hydrogen peroxide. This is with one of the four types of alcohol mentioned, i.e. methyl, ethyl, n-propyl, or isopropyl, and with hydrogen peroxide of 35% strength.

The process of making the additive of the present invention is also an important part of this invention. The sequence of mix of the components set forth is relatively important because of the fact that hydrogen peroxide is a strong and ready oxidizer. Thus, it is far safer to blend the small amount of hydrogen peroxide required as the last part of the process.

The preferred process is as follows:

The desired quantity of alcohol is first placed into a spigot-type bottle. Then the toluene in the desired proportion or quantity is added to the alcohol. After these two are together, they should be thoroughly blended by rigorous shaking of the spigot bottle or other mixing vessel, depending on the size thereof, until the mixture is complete. Then the desired quantity of hydrogen peroxide is added. This is also thoroughly blended with the alcohol and toluene by strong agitation. As soon as the blending is completed, bottling should be immediately started and continued until all the contents of the spigot bottle have been used and the bottle is empty. This is for the purpose of assuring that deterioration of the additives does not occur by reason of any substantial oxygen emission after the processing.

Figures 3, 4:
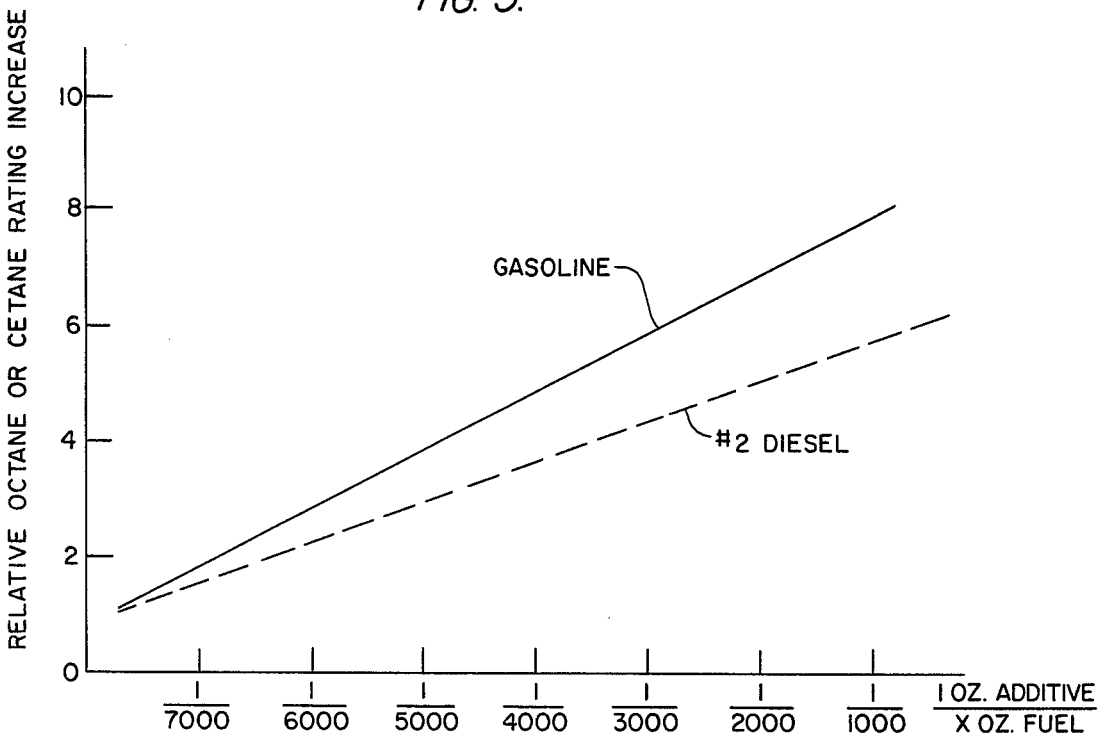
FIG. 3 is a graph showing the additive effectiveness when used with both gasoline and #2 diesel fuel in the quantities indicated.
FIG. 4 is a chart equating the FMR to the BMR for various mixtures of the additive.

It has been discovered that rapid agitation of the basic mixture, i.e. the toluene and alcohol is necessary for a thorough mixing thereof. Then, just before the bottling process is to begin the hydrogen peroxide is added, and again the mixture vigorously agitated. Then the bottling process should be begun immediately. This is to avoid any substantial loss of oxygen from the hydrogen peroxide. Once the final mixture is bottled, the container should be quickly and tightly capped. It has been discovered that packaging of the product can be in both glass bottles and in metal cans of convenient size. However, the use of plastic containers is undesirable and should not be used because oxygen from the final mixture will escape through the plastic container walls if stored for any extended period of time. Thus for maximum shelf life while being distributed and sold, either glass bottles or metal containers must be used. The preferred embodiment mix of 1 part $H_2O_2$, 8 parts toluene, and 16 parts alcohol provides an increase in relative octane and cetane ratings of approximately 5, as shown in FIG. 1. Also, as shown in FIG. 3, when the additive is mixed with gasoline at a ratio of approximately 1 part of additive to 4,000 parts of gasoline, the increase in octane rating is approximately 5. Similarly for #2 diesel fuel mixed in the ratio of 1 part additive to 2,000 parts of #2 diesel fuel, a cetane rating increase of approximately 5 is achieved.

By reference to the figures, it can be seen that variations in the ratio of the proportions of ingredients mixed, as well as the quantity of the mixed additive used in either gasoline or diesel fuel can be varied to achieve varying degrees of performance. In this manner, variations in overall engine performance, applications and compensations for differences in blends of available fuels, and differences in engine uses and applications all can be taken into consideration and adjusted for.

Figure 2:
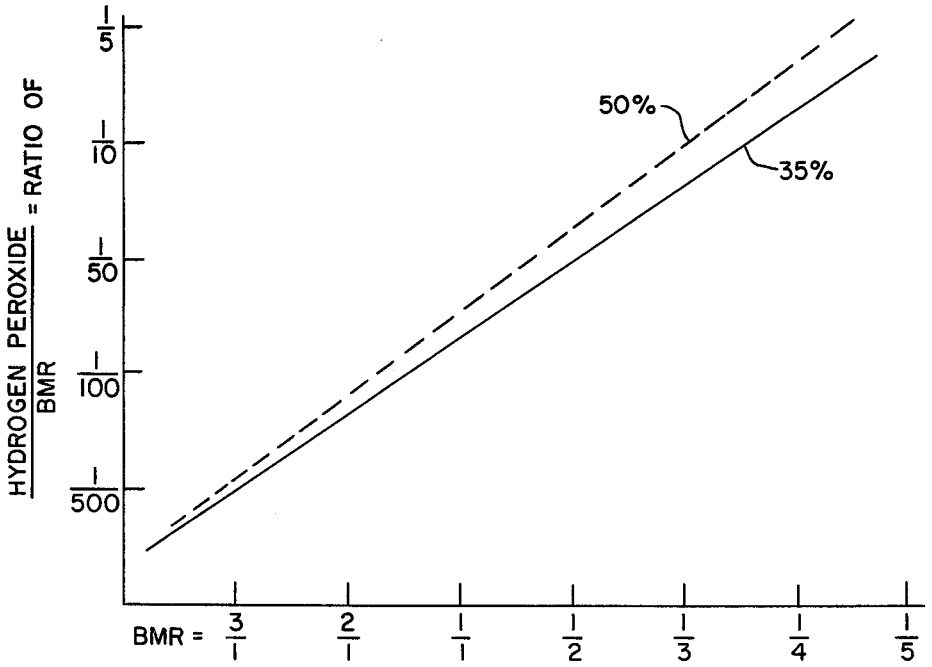
FIG. 2 is a blending chart or graph for achieving the proper mixture of hydrogen peroxide with the basic mixture of toluene and alcohol.

FIG. 2 illustrates that different ratios of hydrogen peroxide to basic mixtures which may be used in order to achieve good blending of the overall additive. It has been discovered that this chart must be closely adhered to in order for the hydrogen peroxide to remain properly mixed with the other components. Otherwise, there oftentimes is a tendency for the components to separate.

The chart of FIG. 2 shows the commonly used concentrations of 35% and 50% hydrogen peroxide. It has been found necessary to closely follow this mix schedule to preclude separation of the water-based hydrogen peroxide from the basic mixture components, as well as from the fuel itself. Because of the increased potency and more caustic nature of the 50% solution of hydrogen peroxide over that of the 35% solution, when bottles are to be hand-filled it is preferable to use the 35% solution. That is, for safety and greater skin protection of the operator. However, with both percentages of $H_2O_2$, it is recommended that rubber or plastic gloves should be worn by the operator for protection. Also, protective eyeglasses or goggles should be worn.

As already indicated, any one of the four listed alcohols may be used for the basic mixture. Also a mixture of two or more of them has been found to be suitable. However, the use of the additive for certain applications may dictate a preference of one type of alcohol over another. For example, the use of methanol is more economical than the others, and in normal automobile-type engine usage has been found to be entirely satisfactory. However, when the additive is to be used with diesel fuel, especially when used in diesel engines of trucks during extremely cold weather, or when small quantities of moisture may be present, n-propyl and/or isopropyl alcohol are to be preferred because they mix more readily with the fuel than either methanol or ethanol. This is believed to be because these propyl alcohols absorb moisture better and so achieve the secondary function of moisture elimination more effectively from the diesel fuel at cold temperatures.

As an additional step of the process of making the additive, a quality control step for the additive to be used with diesel fuel is recommended. This consists of applying approximately 10 drops of diesel fuel to a bottle containing approximately 4½ ounces of the additives. Then 1 or 2 drops of glycerin are added to the overall mixture. If there is any separation of the mixture at this time, the operator then realizes that the Basic Mixture ratio, and/or the Final Mixture ratio is improper for the additive for use with diesel fuel. The operator then can immediately check and determine what error has been made in the previous steps of the process and the mixture ratios, and correct same, rather than capping the bottles with an incorrect mix.

This quality control process step is extremely useful for checking the making of the additive for use with #2 diesel fuel. However, since there is a somewhat unpleasant odor when the diesel and glycerin steps are included with the final mixture steps of the process, this quality control procedure is not used when the additive is being prepared to be used with gasoline. However, it has been discovered that the permissible variations of the mixture when being prepared for use with gasoline is not quite as critical as that with the diesel additive mix, and therefore this additional quality control step is not as necessary for preparing the gasoline additive.

FIG. 4 is a table comparing the suitable Basic Mixture ratios (BMR) with the Final Mixture ratios (FMR) of the completed additives.

From this description and the figures of the drawings, it can readily be seen that subject invention teaches additives and processes of making same which can be varied and used over a great number of variable conditions. In actual practice, the additive as used with both gasoline and diesel fuels has been highly successful.

The additive mixtures of subject invention have certain important features which have been either discovered through actual experimentation, or suggested from these experiments. These features include, the additive when being used in proper proportion with gasoline or diesel fuel for internal combustion engines, yielding better engine performance in the form of: additional power, smoother operation, and either total elimination or at least significant reduction of combustion chamber detonation. That is, ping or knock. The engine also operates with a significant increase in efficiency, and thus operates more economically.

The additive, also because it contains an oxidizer, tends to burn more of the elements of the fuel in a more complete manner thus assuring a cleaner exhaust emission. These elements which are burned include any quantity of crankcase oil which may reach the combustion chamber by bypassing the piston rings. This is a common occurrence in most internal combustion engines.

The additive, containing a combination of one or more alcohols in combination with toluene, increases the effective octane rating of straight-run gasoline, as well as leaded gasolines. This is dependent as shown in the figures upon the toluene/alcohol ratio, and in turn on the amount of the additive mixed with the gasoline. The hydrogen peroxide part of the additive mixture also is extremely important for maintaining the proper blend of the mixture both in the bottled state as well as when mixed with the fuel.

The additive because of the disclosed relationship of the mixture ratios as shown in the drawings, can be predictably prepared to accomplish the desired purposes with given fuel blends for various engines of different compression ratios.

The additive also has a tendency towards increasing the overall volatility of the fuel with which it is mixed. Also because it imparts an increased tendency towards greater oxidation of the fuel, it permits easier and faster starting of internal combustion engines at very low winter temperatures, as well as at normal temperatures.

The additive does not impart any metallic or other harmful coatings to catalytic elements of the catalytic converters of recent automobile exhaust systems. As is well known, tetraethyl lead cannot be used to increase the octane level of lower-level gasolines when the fuel is to be used with engines having catalytic converters in their exhaust systems. The additive of this invention can be used with such converters without any problem.

The additive also has a feature of a cleansing action which improves the overall fuel efficiency of the system with which it is used. When the additive is used consistently with the fuel for internal combustion engines, the overall system after a period of time results in a cleaner, more carbon-free combustion chamber, as well as cleaner spark plugs, valves, jets, etc.

It is believed that the additive can be used with jet-engine fuel with the same desirable results as is achieved when used with a fuel for internal combustion engines. Thus, it is believed that the jet-engine would have increased power, performance, and economy.

The additive, when used in diesel fuel, tends to reduce or eliminate the gelling of the fuel in cold temperatures when small amounts of moisture are present. Thus the additive thins out the gel to preclude fuel obstructions, which is another desirable side benefit.

The additive when used with either diesel or gasoline fuel, tends toward absorption of minute water droplets through the water solubility of the alcohol contained therein, and also precludes possible ice formation in cold temperatures, or in the carburetors of the engines during operation. It is common, for example, in airplane engines for the pilot to experience rough engine operations at higher altitudes if any moisture is present in the fuel since this moisture tends to freeze when passing through the carburetor at certain altitudes. The use of this additive will eliminate this.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. The process of making a fuel additive comprising the steps of:

placing a predetermined quantity of alcohol in a mixing vessel;

adding a predetermined quantity of toluene to said predetermined quantity of alcohol;

blending thoroughly the aforesaid quantities of substances by vigorous agitation of the mixing vessel;

adding a predetermined quantity of hydrogen peroxide; and then blending all together by further vigorous agitation of the mixing vessel.

2. The process of claim 1, including the further step of putting the well blended mixture in a sealable container as soon as possible after the final blending thereof, and then sealing the container tightly immediately thereafter to prevent deterioration of the mixture.

3. The process of claim 1, wherein the predetermined quantity of alcohol to toluene to hydrogen peroxide is in the preferred ratio of 16/8/1.

4. The process of claim 1, with the additional step of adding a few drops of diesel fuel to the blended mixture, and then further adding several drops of glycerin thereto for the purpose of quality control of the overall mixture ratio.

5. A fuel additive comprising: a mixture of;

a predetermined quantity of alcohol;

a predetermined quantity of toluene; and a predetermined quantity of hydrogen peroxide; and all of these predetermined quantities thoroughly blended together.

6. A fuel additive as in claim 5, wherein the predetermined quantity of alcohol, toluene, and hydrogen peroxide is in the preferred ratio of 16/8/1.

7. A fuel additive as in claim 6, wherein said predetermined quantity of alcohol is selected from the group consisting of methyl alcohol, ethyl alcohol, n-propyl alcohol, and isopropyl alcohol.

8. The additive as in claim 7, wherein said mixture further includes a few drops of diesel oil and a few drops of glycerin added thereto for the purpose of quality control of the mixture ratio of the final mixture.

9. A fuel additive as in claim 5, wherein said predetermined quantity of alcohol is selected from the group consisting of methyl alcohol, ethyl alcohol, n-propyl alcohol, and isopropyl alcohol.

10. A fuel additive as in claim 9, wherein said mixture further includes a few drops of diesel oil and a few drops of glycerin added thereto for the purpose of quality control of the mixture ratio of the final mixture.

11. The process of making a fuel additive to be added to a much larger quantity of actual fuel comprising the steps of:

placing a quantity of approximately 16 parts by volume of alcohol in a mixing vessel;

adding a quantity of approximately 8 parts by volume of toluene to said quantity of alcohol;

blending thoroughly the aforesaid quantities of substances by vigorous agitation of the mixing vessel;

adding a quantity of approximately 1 part by volume of hydrogen peroxide; and blending thoroughly all of these substances by further vigorous agitation of the mixing vessel.

12. The process of claim 11, including the further step of putting the well blended mixture in a sealable container as soon as possible after the final blending thereof, and then sealing the container tightly immediately thereafter to prevent deterioration of the mixture.

13. The process of claim 11, with the additional step of adding a few drops of diesel fuel to the well blended mixture, and then further adding several drops of glycerin thereto for the purpose of quality control of the overall mixture ratio.

14. A fuel additive to be added to a much larger quantity of actual fuel comprising: a mixture of;

a quantity of approximately 16 parts by volume of alcohol;

a quantity of approximately 8 parts by volume of toluene;

a quantity of approximately 1 part by volume of hydrogen peroxide; and all of these quantities thoroughly blended together.

15. A fuel additive as in claim 14, wherein said quantity of alcohol is selected from the group consisting of methyl alcohol, ethyl alcohol, n-propyl alcohol, and isopropyl alcohol.

16. A fuel additive as in claim 14, wherein said mixture further includes a few drops of diesel oil and a few drops of glycerin added thereto for the purpose of quality control of the mixture ratio of the final mixture.

17. A fuel additive as in claim 14, wherein said hydrogen peroxide is of 35% strength.

18. A fuel additive as in claim 14, wherein said hydrogen peroxide is of 50% strength.

* * * * *